US006269981B1

(12) United States Patent
Nielsen

(10) Patent No.: US 6,269,981 B1
(45) Date of Patent: Aug. 7, 2001

(54) OIL DISPENSING APPARATUS

(76) Inventor: Reagan Nielsen, 4041 E. 77th St., Tulsa, OK (US) 74136-8024

( * ) Notice: Subject to any disclaimer, the term of this patent is extended or adjusted under 35 U.S.C. 154(b) by 0 days.

(21) Appl. No.: 09/631,035

(22) Filed: Jul. 31, 2000

Related U.S. Application Data

(60) Provisional application No. 60/172,727, filed on Dec. 20, 1999.

(51) Int. Cl.[7] ..... B67D 5/42

(52) U.S. Cl. ..... 222/385; 222/494

(58) Field of Search ..... 222/309, 321, 222/385, 494, 527, 530

(56) References Cited

U.S. PATENT DOCUMENTS

| | | | | |
|---|---|---|---|---|
| 1,866,784 | | 7/1932 | Williams . | |
| 2,521,961 | | 9/1950 | Bacheller | 222/321 |
| 3,124,080 | * | 3/1964 | Sisson | 222/385 |
| 3,184,123 | | 5/1965 | Willshaw | 222/321 |
| 3,653,556 | * | 4/1972 | Moran et al. | 222/385 |
| 3,721,370 | | 3/1973 | Blum | 222/385 |
| 4,524,888 | | 6/1985 | Tada | 222/153 |
| 4,690,375 | | 9/1987 | Vorhis | 251/342 |
| 4,972,972 | | 11/1990 | Goguen | 222/130 |
| 4,978,101 | | 12/1990 | Nakaya et al. | 251/129 |
| 5,038,965 | | 8/1991 | Cater | 222/255 |
| 5,251,445 | | 10/1993 | Farell et al. | 60/474 |
| 5,307,962 | | 5/1994 | Lin | 222/321 |
| 5,350,091 | | 9/1994 | Leete et al. | 222/529 |
| 5,381,932 | | 1/1995 | Humphrey | 222/321 |
| 5,553,757 | | 9/1996 | Wang | 222/321.9 |
| 5,601,211 | * | 2/1997 | Foster | 222/143 |
| 5,620,314 | | 4/1997 | Worton | 417/550 |
| 5,806,721 | | 9/1998 | Tada | 222/153 |
| 5,810,211 | | 9/1998 | Shanklin et al. | 222/501 |
| 5,816,453 | | 10/1998 | Spencer et al. | 222/321.3 |
| 5,881,918 | | 3/1999 | Eichler | 222/135 |
| 5,881,927 | | 3/1999 | Inagawa | 222/321.7 |

* cited by examiner

*Primary Examiner*—Philippe Derakshani
*Assistant Examiner*—Thach H. Bui
(74) *Attorney, Agent, or Firm*—Head, Johnson and Kachigian

(57) ABSTRACT

An oil dispenser for use on two-cycle engines such as outboard motors or other two-cycle engines which require a mixture of oil and gasoline. The invention provides for measured volume displacement of oil via a plunger type pump attached at one end to a first fluid containment vessel via a threaded connection. A flexible tube of appropriate internal dimension and length facilitates transport of oil from said first containment vessel, through said pump to, and through a said flexible tube and valve located on the opposite terminus of said invention and into a second fluid containment vessel.

6 Claims, 4 Drawing Sheets

OIL DISPENSING APPARATUS

REFERENCE TO PENDING APPLICATION

This application is a continuation-in-part to Provisional Patent Application No. 60/172,727 filed Dec. 20, 1999 entitled "Improved Oil Dispensing Apparatus".

REFERENCE TO MICROFICHE APPENDIX

This application is not referenced in any microfiche appendix.

TECHNICAL FIELD OF THE INVENTION

In general, the present invention relates to fluid dispensing mechanisms providing for require a measured volume displacement of fluid. In particular, the present invention is directed to an oil dispenser for use on two-cycle engines which require a mixture of oil and gasoline according to a predefined ratio.

BACKGROUND OF THE INVENTION

Fluid dispensing mechanisms are well known and represented within the prior art:

U.S. Pat. No. 1,866,784 issued to C. L. Williams on Jul. 12, 1932 discloses a one-hand oil rifle.

U.S. Pat. No. 2,521,961 issued to D. F. Bacheller on Sep. 12, 1950 discloses a catchup dispenser.

U.S. Pat. No. 3,184,123 issued on May 18, 1965 to Philip Joseph Stretton Willshaw relates to a dispenser used to withdraw liquid from a container. In one form, the dispenser is provided with a normally fixed, hollow, cylindrical casing, which may be held by hand or by any other means. An end piece on the forward end of the casing is used to enclose or house a first one-way valve to permit entry of the liquid from the container into the casing. A cap on the rearward end has an opening therein through which a plunger comprising a tubular rod makes a sliding fit. The plunger is slidably sealed to the inside of said casing by sealing means at or adjacent the forward end of the rod. An outlet tube and a second one-way valve are supported at the rearward end.

U.S. Pat. No. 3,721,370 issued to Marshall R. Blum on Mar. 20, 1973 discloses an apparatus for dispensing materials from disposable cartons of the type having a sloping top provided with a central upstanding seal closing the top. The apparatus includes a pair of sloping sides which conform to the top of the carton and means interconnecting the sides for attaching the same to the seal. One of the sides has a hole there through for receiving a pump which is adapted to extend into the carton and operable to remove the contents thereof. The other side of the device can be provided with a second hold defining a template for use in cutting a hole in the carton.

U.S. Pat. No. 4,524,888 issued to Tetsuya Tada on Jun. 25, 1985 discloses a dispenser which has a piston attached to its head and a cylinder attached to its cap and which is constructed so that it may be fitted onto a vessel through the cap and so that it may, in accordance with the sliding movement of the piston, such up a liquid in the vessel into the cylinder through a primary valve and pressurize the liquid to cause the same to issue outside the dispenser through a secondary valve. The dispenser has a child-proofing mechanism including a protruded portion formed on the cap and having an engagement groove and an engagement projection formed on the inner wall surface of the head and, by being rotated with the piston located at its depressed position, engaged with the engagement groove of the protruded portion to lock the piston made integral with the head to its depressed position. An engagement projection or engagement groove is formed on or in the outer wall surface of the cap. An engagement groove or engagement projection is formed in or on the head engageably with the engagement projection or engagement groove of the cap. The dispenser has a mechanism for preventing the rotation and rising movement of the head, formed on a virgin seal removably disposed between the cap and the head.

U.S. Pat. No. 4,690,375 issued to Daniel J. Vorhis discloses an improved self closing valve for use with fluid dispensing containers comprising of a resilient and deformable valve body into which one or two wafers of similar material are permanently inserted causing a normal state of blockage and seal. Manual pressure on the valve body causes all components to deform, allowing passage of a fluid.

U.S. Pat. No. 4,972,972 issued to Daniel J. Goguen on Nov. 27, 1990 discloses a portable fuel dispensing container as defined by an elongate enclosed housing formed with a first forward wall spaced from a second forward wall defining a hose chamber forward of a fuel chamber. The container includes a pressured discharge cap positioning rearwardly through a top wall of the container with a pressurizing jump positions through the top wall of the container adjacent the second chamber. A rigid hose includes a horizontal leg positioned within the fuel chamber, and a vertical leg directed through the forward wall of the container and extending upwardly there along terminating in a coupling for securement to a flexible hose. The flexible hose includes a discharge nozzle at a free end thereof to enable remote filling and discharge of fuel contained within the fuel chamber when pressurized.

U.S. Pat. No. 4,978,101 issued to Toshitaka Nakaya on Dec. 18, 1990 discloses a valve unit of a solenoid controlled valve which is disposed at the tip end of a tubular member which at a location remote from the tip end is connected to the plunger of the electromagnetic drive unit of the solenoid. A linear member inserted in and passing through the tubular member connects the plunger to the valve body of the valve unit. A liquid is conducted into the tubular member from a source. The solenoid controlled valve controls the flow of the liquid through the tubular member.

U.S. Pat. No. 5,038,965 issued to Miro S. Cater on Aug. 13, 1991 discloses a pump dispenser for delivering a predetermined dosage regardless of method of actuation wherein a finger operated pump dispenser employs interconnected upper and lower cylinders, first and second pistons disposed in the upper and lower cylinders, a hollow sleeve, and a stem which extends upwardly through the first piston into the sleeve. The first cylinder, the stem and the two pistons define a pump chamber which is filled with fluid. When the dispenser is actuated, fluid is displaced from the chamber into the second cylinder and a port is opened. The port can be made to open at the moment that all of the fluid is displaced into the second cylinder. Once the port is opened, the fluid is discharged and further piston movement enables fluid to be pulled upward out of the container secured to the dispenser via an opening formed between the second piston, stem and inner wall of the second cylinder refilling the chamber. The motions of pistons, stem and sleeve are so controlled that accurate dosage is produced independently of the method of actuation.

U.S. Pat. No. 5,251,445 issued to Robert E. Farrell on Oct. 12, 1993 discloses an airless hand held hydraulic pump unaffected by gravity that continuously maintains pressure on the fluid in a dynamic reservoir chamber to enable pumping into a dynamic pressure chamber for actuating a forcing rod irrespective of the orientation of the pump. A release valve permits fluid return from the pressure chamber into the reservoir chamber. The pump can be fitted with a tool such as a door forcer.

U.S. Pat. No. 5,307,962 issued to Hui-Yu Lin on May 3, 1994 discloses a container mounted pump with improved check valve structure. An improved pump-head structure, which has a valve annulus mounted on the inlet to the lower end of a liquid accumulator of the pump-head structure to prevent leakage of a liquid from the liquid accumulator. A plunger valve is connected to the valve annulus via a spring piece, which exerts a downward force on the plunger valve and thus maintains the inlet of the lower end of the liquid accumulator forcedly and tightly closed under normal conditions by the downward action of the plunger valve.

U.S. Pat. No. 5,350,091 issued to Jeremy S. Leete on Sep. 27, 1994 discloses a fuel pouring nozzle for use on vented fuel containers that has a base adapted to be attached to a vented fuel container. The base has an end portion at a first end, a downstream end at a second end and a radially extending circumferential ridge situated on the end portion. There is a tubular valve body having a cylindrical side wall with an opening therein, an upstream end having a valve seat and a downstream end having a female threaded portion. A tubular conduit is connected to the upstream end of the valve body and the downstream end of the base. A first O-ring is fitted to the valve seat and faces the downstream end of the valve body. A second O-ring is fitted about the opening in the side wall inside the valve body. A ball valve is positioned in the valve body against both O-rings. The ball valve has a stem extending through the opening in the side wall and is rotatable about a longitudinal axis through the stem. There is handle exterior to the valve body and connected to the stem of the ball valve. A tubular member has an upstream end with a male threaded portion engaging the female threaded portion of the valve body, an accordion-like, snap-lock, segmented portion attached to the male threaded portion and a narrowed, rigid tubular section connected to the segmented portion and forming a spout. There is a closure cap having a protrusion on one side which releasably fits with the base to seal the nozzle and has a slot to releasably engage the handle on the ball valve so the cap acts as a knob to open and close the valve.

U.S. Pat. No. 5,381,932 issued to James E. Humphrey on Jan. 17, 1995 discloses an improved condiment pump which has a container and a lid. The cylinder extends downwardly into the container and contains a piston and a piston rod. A lower ball valve is located near the bottom of the cylinder, and a side arm tube extends upwardly from the upper ball valve. An upper ball valve is located at the top of the side arm tube, and a spout extends upwardly from the upper ball valve. A plug covers the upper end of the upper ball valve. A spout extension extends downwardly into the upper ball valve to maintain the ball a predetermined distance from a hole in the plug, permitting passage of condiment chunks through the spout.

U.S. Pat. No. 5,553,757 issued to Ming-The Wang on Sep. 10, 1996 discloses a cream dispenser head which includes an accumulator shell having a dip tube at its bottom, a cap, a one-piece sleeve, and a piston inserted through the sleeve driven to pump cream out of the cream dispenser. The sleeve has a bottom end fitted through a center tube of the cap and disposed with the accumulator shell. The sleeve includes an outside flange around its periphery, adjacent the bottom end, defining an upper annular groove and a lower annular groove, sealingly engaging the inner surface of the accumulator shell. The sleeve includes an outward annular flange stopped against eh cap center tube. The piston has a tubular piston body and a spring holder fixedly connected to one end of the tubular piston body, stopped against a spring inside the accumulator chamber. The piston includes a plurality of projecting portions stopped against the inside wall of the accumulator shell and a radial through-hole at one end, adjacent to the spring holder. Two mounting flanges, located on the outer surface of the piston, on an end distal to the spring holder, couple a saddle head. The spring holder and the outside flange of the piston define a gap for guiding the cream from an accumulator chamber, through the radial through-hole and into the tubular piston body.

U.S. Pat. No. 5,620,314 issued to David M. Worton on Apr. 15, 1997 discloses a hand-operated, portable, easily-manufactured liquid pump offering efficiency through advanced plunger design, ease of repairability, and enhanced versatility through use of a selected group of inlet and outlet accessories. The pump preferably includes a cylindrical housing, a bottom end forming an inlet port, and a top end with an exhaust port located near the top end. A field-repairable plunger assembly having a plunger which is preferably a rubber diaphragm is located within the cylindrical housing and is connected to a rod and handle for reciprocating the plunger within the housing. A unidirectional flow device is operatively connected to the bottom end of the housing to allow fluids to flow in a direction from the inlet port toward the exhaust port while preventing fluid flow in the opposite direction. The pump may be constructed to allow disassembly from the bottom end or the top end to allow a user to service the pump in the field and to replace worn or failing components. The pump housing and rod volumes are preferably selected to provide efficient ergonomic pumping action on both upstroke and downstroke movement. The plunger mechanism may include an enlarged cup member connected to the rod above the plunger to relieve a significant portion of the pressure applied by the column of liquid in the housing to the plunger during upstroke movement. A variety of plunger and pump rod designs are also discussed.

U.S. Pat. No. 5,806,721 issued to Tetsuya Tada on Sep. 15, 1998 discloses a container mounted pump dispenser with back suction. A push-type dispenser, in which the primary valve has a rod extending in the piston, and the secondary valve is mounted on the primary valve, is provided in the piston and can move in interlock with the primary valve due to the friction between it and the primary valve. A stopper formed on the piston and located above the secondary valve kicks the secondary valve, releasing the secondary valve from interlock with the primary valve and pushing the secondary valve downwards along with the piston. The secondary valve is closed with a delay after the nozzle head and the piston start moving upward. The primary valve is prevented from opening until the secondary valve is closed, thereby to suck the residual liquid back into the cylinder from the nozzle and the piston.

U.S. Pat. No. 5,810,211 issued to Donald J. Shackling on Sep. 22, 1998 discloses an assembly including a pump attachment particularly adapted to form an non-aerosol pump sprayer, and a method of using the same. The apparatus desirably includes an attachment having a pump sprayer which is pressurized on the upstroke enabling the sprayer to be shipped and stored in a relaxed position. The assembly incorporates a grip including a handle portion having a first inner wall defining a first flow channel having a first outlet and a stem portion defining a second inner wall defining a second flow channel having a second outlet. The first flow channel and the second flow channel intersect at the outlet of the second flow channel. A plug is mounted within the first flow channel having a first position wherein the plug prevents fluid flow from the second outlet to the first outlet and a second position wherein the plug permits fluid flow from the second outlet to the first outlet. The assembly is further provided with an adaptor having an inner section sized and shaped to be insertable into the first flow channel to move the plug between the first position and the second position.

U.S. Pat. No. 5,816,453 issued to Jeffrey W. Spencer on Oct. 6, 1998 discloses a dispenser pump which has an arrangement for sucking material out of its discharge nozzle after a dispensing stroke, to avoid clogging. The material is sucked through a suck-back passage provided by minor non-complementarity between a resilient outlet valve disc and its valve seat. The ball of the inlet valve is arranged to travel vertically in a tubular portion of the inlet passage in which it is a blocking fit, between its valve seat and an open cut portion where fluid flows freely past it into the pump chamber. During recharging at the pump chamber the ball is held in the open cut position. Once recharging stops, the ball falls gradually down the tubular position, drawing liquid back through the pump chamber until the inlet valve reseats.

U.S. Pat. No. 5,881,918 issued to Barbara. Eichler on Mar. 16, 1999 discloses a multi-liquid dispenser comprising a housing having at least one vertical partition positioned within its interior to define separate chambers. A removable cover formed with a depending rim, abuts the interior wall of the hosing, thereby forming a fluid-tight seal between the housing and the cover. The rim is formed with at least one transverse channel dimensioned to receive the vertical partition, thus creating a barrier which prevents fluid contained in one chamber from migrating to an adjacent chamber. A series of pumps are carried by the cover, with each pump being dedicated to a particular chamber.

U.S. Pat. No. 5,881,927 issued to Yoshinori Inagawa on Mar. 16, 1999 discloses a pump mechanism wherein it is attached to a container to fill a liquid and to eject the liquid from the container, the pump mechanism includes: a cylinder having a liquid introduction port; a piston which is displaceable in the cylinder; an ejection guide path for the liquid, the path being communicated with the space int eh cylinder, the liquid stored in the cylinder being ejected via the ejection guide path by a pushing force which causes the piston to be displaced from the original position to a displaced position; and a recovery device for restoring the piston from the displaced position to the original position by a gas pressure and storing the liquid in the cylinder when the pushing force is released. The pushing force causes the space in the piston to enter a substantially vacuum state, and the gas pressure is generated by a pressure difference between the internal pressure of the space and atmospheric pressure acting via the liquid on the piston. With the pump mechanism, when it is to be subjected to a disposal process or a recycle process, it is not required to conduct selection according to the material and which can be therefore subjected to such a process at a low cost.

However as can be seen by mechanisms of the prior art, such mechanisms fail to provide for a measured displaced volume of first fluid into a second fluid contained within a second fluid containment vessel, consistent with predefined mixing ratios for combining such fluids. The instant invention in an economical, reasonable and exacting manner addresses the deficiencies of the prior art by disclosing and claiming an apparatus to introduce a measured displaced volume of a first fluid, contained with a first fluid containment vessel, to a second fluid contained within a second fluid containment vessel consistent with a predefined mixing ratio for combining such first and second fluids.

BRIEF SUMMARY OF THE INVENTION

An apparatus for use in conjunction with two-cycle engines such as outboard motors, chain saws, tillers, or other two-cycle engines which require a requisite mixture of oil and gasoline. The invention provides for an appropriately measured displacement of oil via a plunger type pump attached at one end to a first fluid containment vessel, such as an oil container with a threaded cap via a threaded connection. A flexible tube of appropriate internal dimension and length facilitates transport of oil from said first containment vessel through said pump to, and through said flexible tube and one-way ball valve located on the opposite terminus of said invention, into a second containment vessel, intended to accommodate oil and gas mixtures.

Consequently, it is a primary object of the instant invention to provide a measured displaced volume of a first fluid contained within a first containment vessel into a second fluid contained within a second fluid containment vessel, consistent with predefined mixing ratios for combining such fluids.

It is a further object of the instant invention to provide for measured mixing of two fluids within a sealed, non-spillable mixing environment.

It is yet another is yet another object of the instant invention to permit various valve types, and various configurations of said valve types, when practicing alternative embodiments of said invention.

Other objects and further scope of the applicability of the present invention will become apparent from the detailed description to follow, taken in conjunction with the accompanying drawings wherein like parts are designated by like reference numerals.

DESCRIPTION OF THE INVENTION

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

Figure 1:
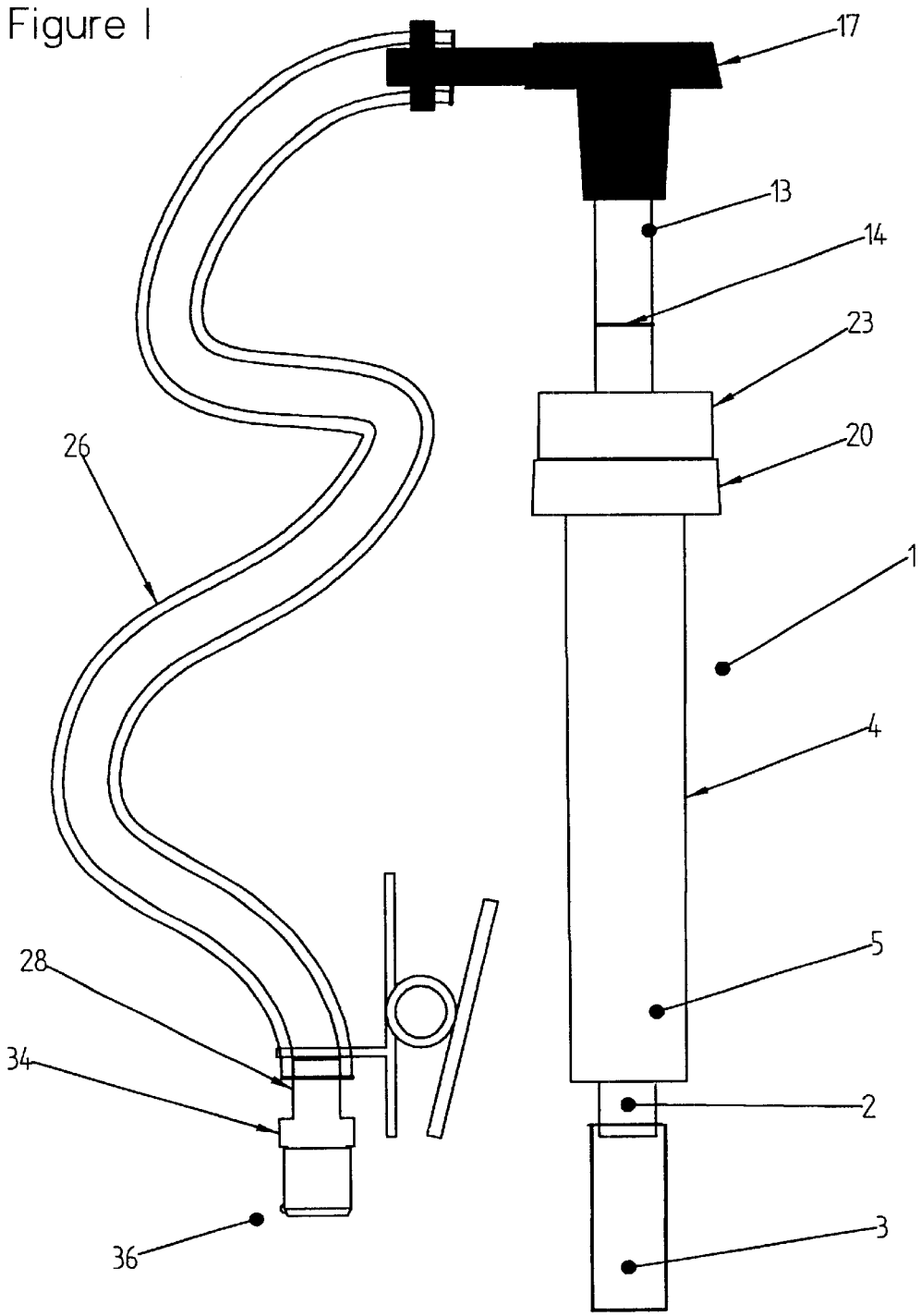
FIG. 1 illustrates an external view of the invention's preferred embodiment primary components.

FIG. 1 illustrates an external view of the invention in its preferred embodiment. A plunger type pump 1 is attached to a first fluid containment canister, such as, but not limited to, an oil container with a threaded cap by way of a screwing-type mechanism, such as a threaded retaining cap 20, attached to a reciprocal threading mechanism embodied as part of said first fluid containment vessel. A pump cap 23 is threaded into a cylindrical housing 4, thus forming an air-tight seal within the interior of the cylindrical housing 4. A dispensing cap 17 is connected to an inlet pipe 13, which, when raised vertically, draws fluid, such as oil, through an inlet tube 3 into the inlet pipe 13, through a charging tube 5, out of the dispensing cap 17 into a flexible hose 26 connected to a male hose fitting 28 and into and through a one-way valve 36. The plunger-type pump 1 is attached to said first fluid containment vessel by extending the pump's cylindrical housing 4 and inlet tube 3 into the first fluid containment vessel. Once positioned within said containment vessel, the threaded retaining cap 20 is screwed onto a reciprocating threaded attachment means incorporated as part of the body of the fluid containment vessel. The one-way check valve 36 insures that once the inlet tube 3, charging tube 5, dispensing cap 17, hose 26 and one-way valve 36 have been primed via repetitive upward and downward movement of the inlet pipe 13, the aforestated invention elements remain charged such that any subsequent upward movement of the inlet pipe 13 results in an exiting of fluid volume through the one-way valve 36 consistent with, and equal to the internal volume capacity of the charging tube 5. For further exactness of measure, indicators 14 representative of various displaced fluid measures are affixed to, or otherwise indicated along the inlet pipe 13 for user reference.

Figure 2:
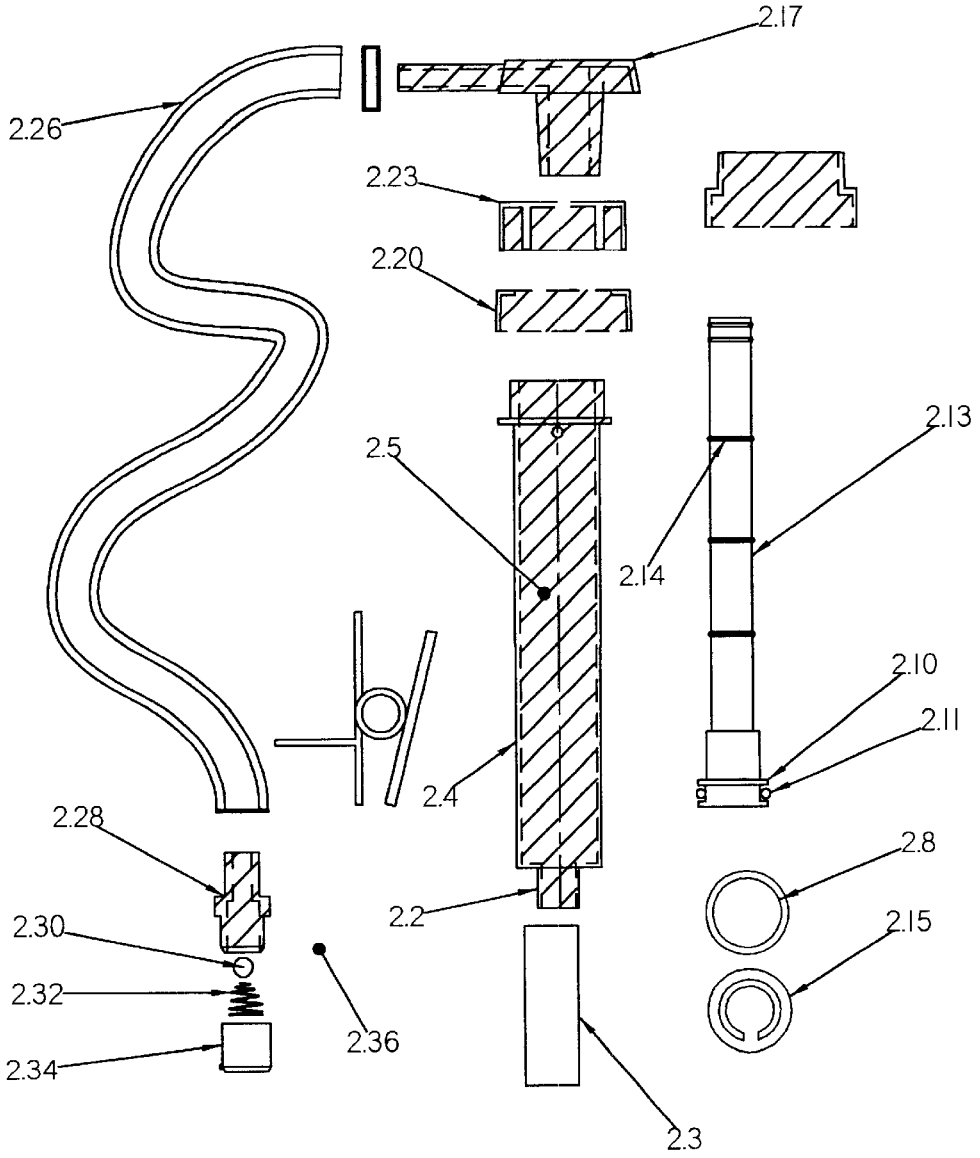
FIG. 2 illustrates an exploded view of components comprising the invention's preferred embodiment.

FIG. 2 illustrates an exploded view of the components comprising the invention's preferred embodiment. A number of components are housed within or affixed to the cylindrical casing 2.4. An inlet tube 2.3 with or without displaced fluid measure indicators 2.14, and of varying length to accommodate design and capacity variations in first fluid containment vessels is inserted into a projection 2.2 on the bottom of the cylindrical casing 2.4 and extended to a generally lower region of a first fluid containment vessel, such as an oil can. Alternatively, said tube 2.3 can be inserted into the projection of the cylindrical casing 2.4 or said projection 2.2 may be inserted within the inlet tube 2.3 for air-tight connection purposes. Said inlet tube 2.3 is constructed of flexible composition, such as but not limited to, vinyl, rubber, etc. A flapper valve 2.15 and retaining ring 2.8 are positioned within the bottom of the internal portion of the charging tube 2.5 and allow for the drawing of fluid within the first fluid containment vessel into the charging tube 2.5. Said flapper valve 2.5 is intended to allow drawing and sealing of said fluid within the charging tube 2.5 and preventing such fluid from exiting the charging tube 2.5 when used in conjunction with a one-way check valve 2.36. A retaining cap 2.20 is used to affix the plunger-type pump to the containment vessel by way of threaded attachment means internal to the retaining cap 2.20 and external to the containment vessel. A plunger-type pump cap 2.23 provides the means by which the inlet pipe 2.13, plunger 2.10, and dispensing cap 2.17 are affixed to the cylindrical casing 2.4. To minimize wear upon said plunger 2.10 a compatible sealing article such as, but not limited to, an O-ring 2.11 may be used in conjunction with said plunger 2.10. Fluid flow is consistent with that described with reference to FIG. 1 via the upward movement of the inlet tube 2.13 and plunger 2.10. Having traversed the flexible hose 2.26, the fluid passes through a male hose fitting 2.28 and due to incoming fluid pressure, depresses a ball bearing 2.30 onto a spring 2.32 and allows the exiting of a volume of fluid consistent with and equal to the internal volume capacity of the charging tube 2.5 through a complimentary hose fitting 2.34 which may include a resealable cap to minimize fluid leakage. Said resealable cap would include but not limited to articles of manufacture similar to these commonly found and utilized in household applications (toothpaste, polish, foodstuffs, etc.). Once the invention has been primed, the invention remains consistently charged until such time as a first fluid containment vessel, such as an oil can, is depleted of its fluid volume. Once the fluid has exited the complimentary hose fitting 2.34 and entered into a second containment vessel, such as a vessel intended to house oil and gas mixtures, pressure is relieved in the one-way valve 2.36 and a spring 2.32 embodied within the one-way valve 2.36 allows the ball bearing to return to its position within the male hose fitting 2.28 and allows an air tight seal to remain in place, thus maintaining the invention's charged status. A subsequent depression of the inlet pipe 2.13 and plunger 2.10 allows for a refilling of the charging tube 2.5. A subsequent upward movement of the inlet pipe 2.13 and plunger 2.10 allows for the traversing of fluid volume within the charging tube 2.5 to facilitate repeated dispersion and introduction of said volume of fluid consistent with that previously described in association with FIGS. 1 and 2.

Figure 3:
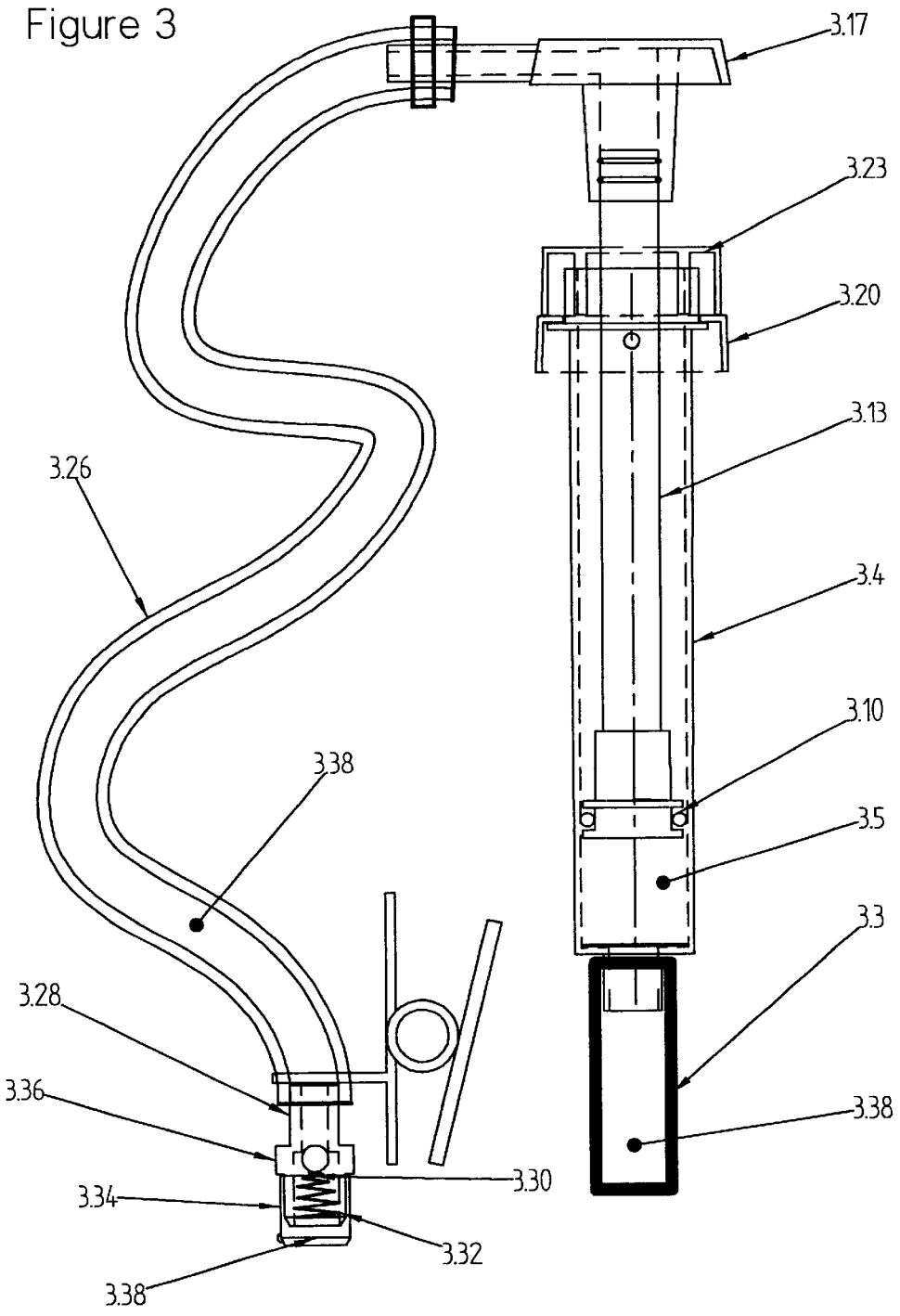
FIG. 3 is a cross-sectional view of the instant invention further illustrating detailed interrelationships and positioning of the invention's internal components.

FIG. 3 illustrates a cross-sectional view of the instant invention illustrating further detail of interrelationships and positioning of the invention's internal components. The internal components and relationships of the instant invention are clearly defined in FIG. 3 wherein 3.3 represents the inlet tube; 3.5 represents the internal portion of the charging tube, 3.10 represents the plunger seal; 3.4 represents the cylindrical housing; 3.13 represents the inlet pipe; 3.20 represents the retaining cap for affixing the instant invention to a first liquid containment vessel, such as an oil can or bottle; 3.23 represents the securing cap for affixing the plunging mechanism to the cylindrical housing 3.4, 3.17 denotes the dispensing cap, 3.26 represents a hose connected to said dispensing cap 3.17 and to a one-way valve 3.36, consisting of a ball bearing 3.30, spring 3.32 and complimentary hose fitting 3.34. Further attention is drawn to the direction of fluid as it traverses the inlet tube 3.3, charging tube 3.5, dispensing cap 3.17, hose 3.26 and valve 3.36; said direction noted as element 3.38.

Figure 4:
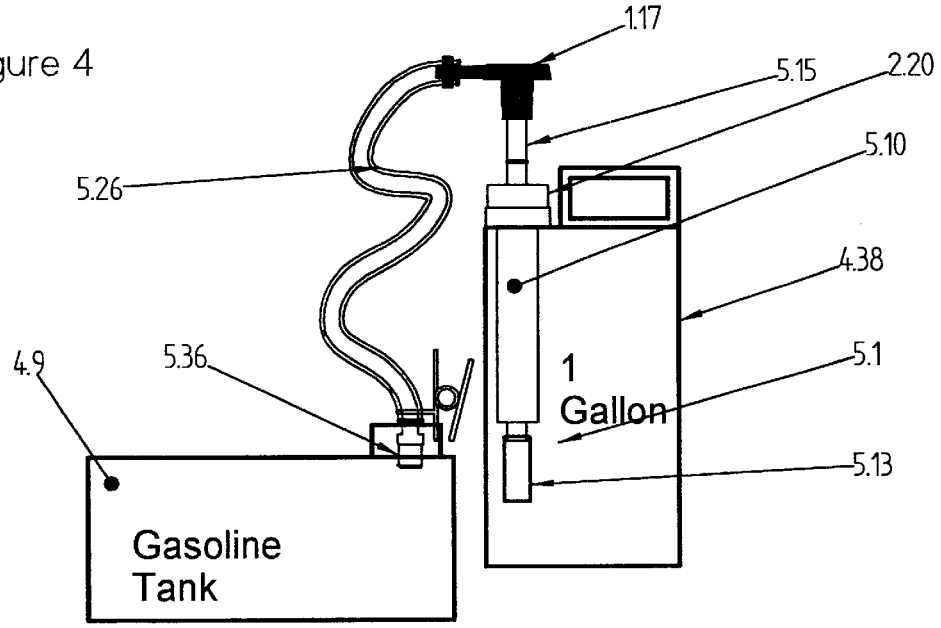
FIG. 4 illustrates the present invention affixed to first and second containment vessels prior deploying and introducing a pre-measured amount of fluid to said second containment vessel.
Figure 5:
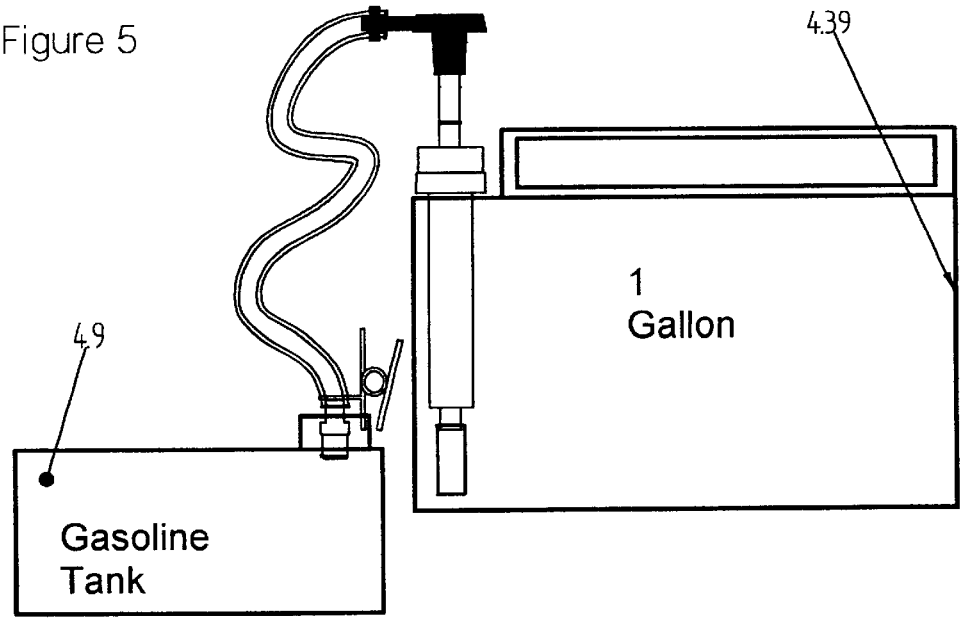
FIG. 5 illustrates the present invention affixed to first and second containment vessels subsequent to being deployed and introducing a pre-measured amount of fluid to a second containment vessel.

FIG. 4 illustrates the present invention affixed to first containment vessel prior to being deployed and introducing a pre-measured amount of fluid into said second containment vessel 4.9. In FIG. 4, the instant invention is shown attached to a first containment vessel 4.38 and inserted into a second containment vessel 4.39. FIG. 5 illustrates the instant invention having been deployed to effectuate the charging tube hose 5.26 and one-way valve. The initial priming of the present invention comprising the plunger-type pump 5.1, the flexible hose 5.26 and one-way valve 5.36 requires several upward and downward movements of the inlet pipe 5.13 and seal 5.10. Once fully charged, a subsequent depression and upward movement of said plunger 5.10 and tube 5.15 causes an injection fluid into the second containment vessel 4.39 consistent with that described in association with FIGS. 1 and 2.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A single prime apparatus for immediately and repeatedly dispensing an exact measured volume of fluid comprising:

an inlet tube;

a cylindrical housing connected to said inlet tube;

a pump house within said housing;

a retaining cap encircling said cylindrical housing at the generally upper portion of said housing;

a plunger cap positioned above said retaining cap and attached to said cylindrical housing;

a dispensing cap attached to a pump;

a flexible hose attached at a first end to said dispensing cap; and a one-way check valve attached at a second end of said flexible hose.

2. The apparatus for dispensing a measured volume of fluid according to claim 1 further comprising a complimentary hose fitting attached to said flexible hose.

3. The apparatus for dispensing a measured volume of fluid according to claim 1 wherein said pump further comprises:

a plunger seal connected to said inlet tube;

a flapper valve and retaining ring connected to said plunger seal.

4. The apparatus for dispensing a measured volume of fluid according to claim 1 wherein said pump further comprises:

a plunger seal connected to said inlet tube;

a flapper valve and retaining ring connected to said plunger seal;

an o-ring seal inserted within said flapper valve.

5. The apparatus for dispensing a measured volume of fluid according to claim 1 wherein said complimentary hose fitting further comprises a resealable cap.

6. A singular prime apparatus for immediately and repeatedly dispensing an exact measured volume of fluid comprising:

an inlet tube;

a cylindrical housing connected to said inlet tube;

a plunger seal connected to said inlet tube;

a flapper valve and retaining ring connected to said plunger seal;

a retaining cap encircling said cylindrical housing at the generally upper portion of said housing;

a plunger cap positioned above said retaining cap and attached to said cylindrical housing;

a dispensing cap attached to a pump;

a pump having a dispensing cap;

a flexible hose attached at a first end to said dispensing cap;

a one-way check valve attached at a second end of said flexible hose; and a complementary hose fitting attached to said flexible hose.

* * * * *